US011913292B2

(12) United States Patent
Donzier et al.

(10) Patent No.: US 11,913,292 B2
(45) Date of Patent: Feb. 27, 2024

(54) PRODUCTION LOGGING TOOL AND DOWNHOLE FLUID ANALYSIS SENSORS VERTICAL DEPLOYING METHOD

(71) Applicant: OPENFIELD, Versailles (FR)

(72) Inventors: Eric Donzier, Bercheres sur Vesgre (FR); Linda Abbassi, Katy, TX (US); Emmanuel Tavernier, Paris (FR)

(73) Assignee: OPENFIELD, Versailles (FR)

( * ) Notice: Subject to any disclaimer, the term of this patent is extended or adjusted under 35 U.S.C. 154(b) by 0 days.

(21) Appl. No.: 17/577,273

(22) Filed: Jan. 17, 2022

(65) Prior Publication Data

US 2022/0228447 A1 Jul. 21, 2022

(30) Foreign Application Priority Data

Jan. 18, 2021 (FR) ..... 2100465

(51) Int. Cl.
*E21B 17/10* (2006.01)
*E21B 47/01* (2012.01)

(52) U.S. Cl.
CPC ..... *E21B 17/1021* (2013.01); *E21B 47/01* (2013.01)

(58) Field of Classification Search
CPC ..... E21B 47/01; E21B 47/10; E21B 17/1021; E21B 49/087
See application file for complete search history.

(56) References Cited

U.S. PATENT DOCUMENTS 4,343,451 A * 8/1982 Armstrong ..... H05K 7/02 248/500
5,574,263 A * 11/1996 Roesner ..... E21B 47/10 166/250.11
7,114,386 B1 10/2006 Veignat
(Continued)

*Primary Examiner* — Feba Pothen
*Assistant Examiner* — James Split
(74) *Attorney, Agent, or Firm* — The Jansson Firm; Pehr B. Jansson

(57) ABSTRACT

A production logging tool (1) comprising an elongated cylindrical body (10) of longitudinal axis (XX'), the body (10) carrying an articulated dual arms deploying arrangement (12), at least one arm carrying at least one sensor (16, 16A, 16B) to analyze at least one property of a multiphase fluid mixture (MF) flowing in a hydrocarbon well (2), said sensor (16, 16A, 16B) extending along a sensor axis (SS'), the articulated dual arms deploying arrangement (12) comprising two deploying arms (13A, 13B) and a sliding sleeve (19), the deploying arms (13A, 13B) being operable from a retracted configuration into a vertically extended configuration, the deploying arms (13A, 13B) being coupled together through an outermost end hinge (17) at outermost ends of said deploying arms (13A, 13B), one arm (13A) being coupled to a first end part of the body through a first hinge (23A) at another deploying arm end, and the other arm (13B) being coupled to a second end part of the body through a sliding sleeve hinge (26) at the sliding sleeve (19) at another deploying arm end, wherein the articulated dual arms deploying arrangement (12) further comprises a pantographic mechanism (14) arranged such that the sensor axis (SS') stays substantially parallel to the longitudinal axis (XX') for any opening of the deploying arms (13A, 13B) from the retracted configuration to the vertically extended configuration.

12 Claims, 16 Drawing Sheets

(56) References Cited

U.S. PATENT DOCUMENTS

| | | | | |
|---|---|---|---|---|
| 7,301,609 | B2 * | 11/2007 | Cens | E21B 47/10 356/28 |
| 7,891,422 | B2 * | 2/2011 | Maclean | E21B 47/01 166/250.01 |
| 8,630,817 | B2 * | 1/2014 | Fraser | E21B 47/08 73/152.01 |
| 10,876,394 | B2 * | 12/2020 | Hill, III | E21B 47/01 |
| 2016/0130935 | A1 | 5/2016 | Manzar | |
| 2020/0209193 | A1 | 7/2020 | Swett | |

* cited by examiner

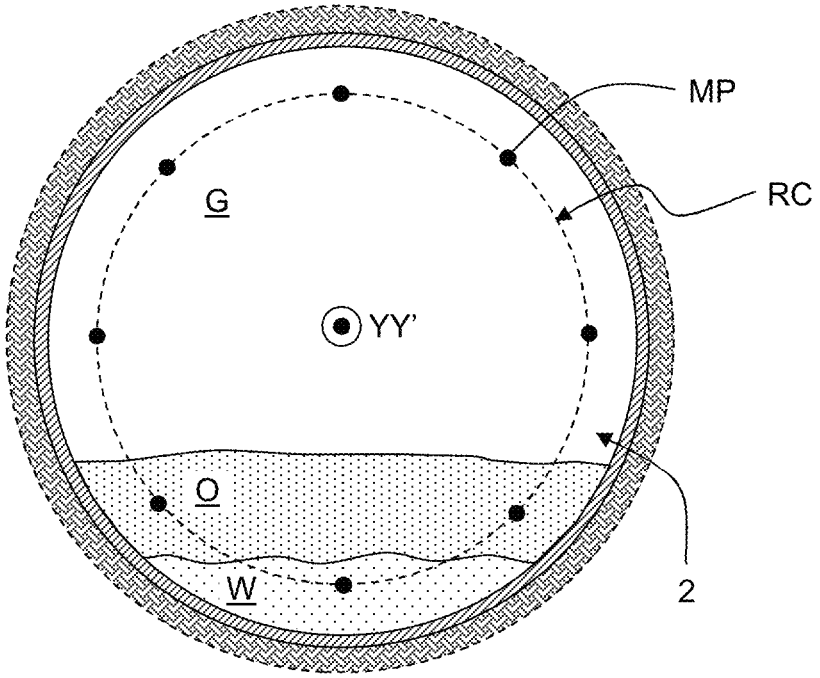
FIG. 1 – Prior Art
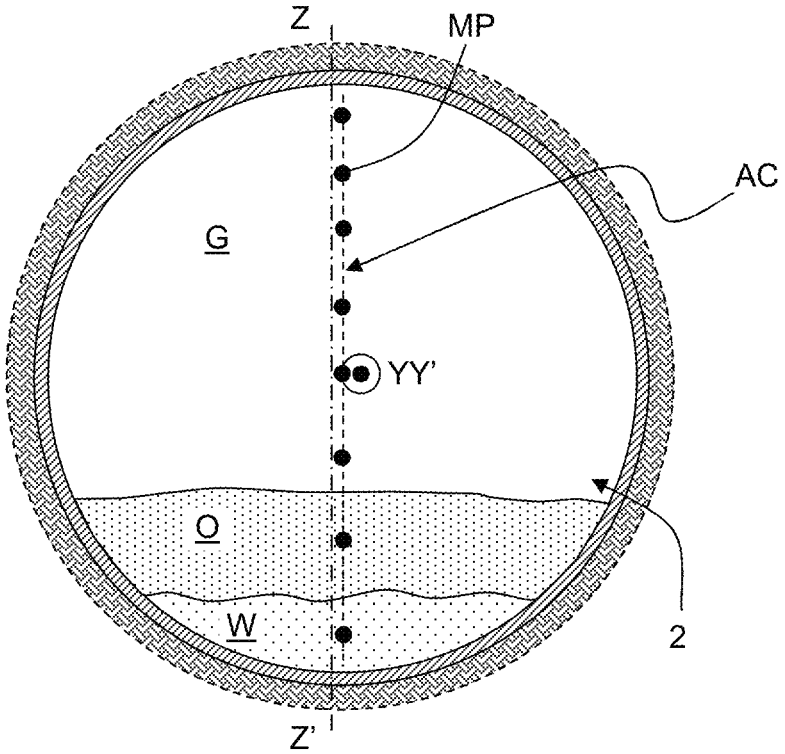
FIG. 2 – Prior Art

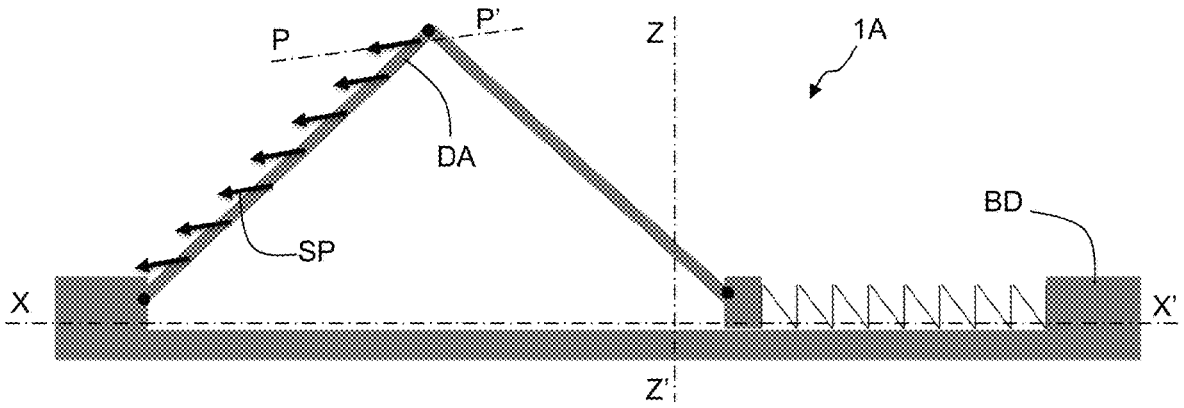
FIG. 3 – Prior Art
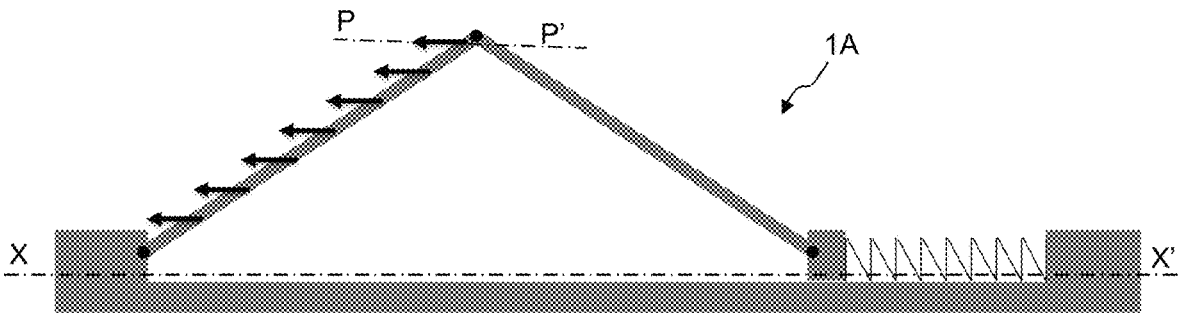
FIG. 4 – Prior Art
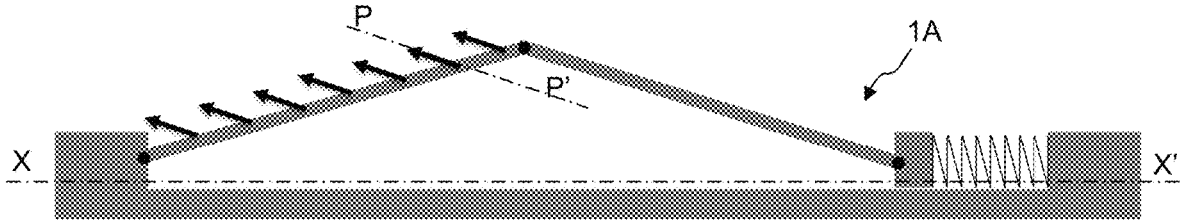
FIG. 5 – Prior Art
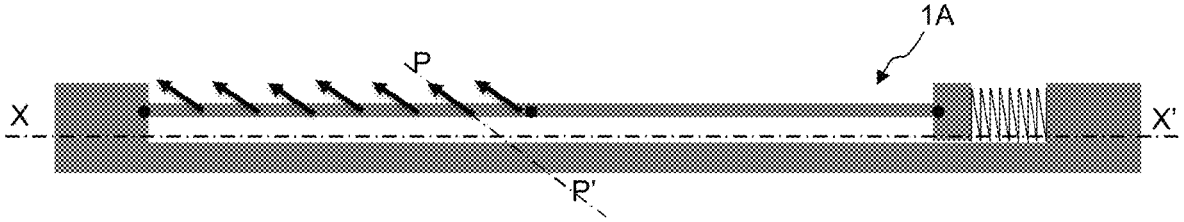
FIG. 6 – Prior Art

PRODUCTION LOGGING TOOL AND DOWNHOLE FLUID ANALYSIS SENSORS VERTICAL DEPLOYING METHOD

TECHNICAL FIELD

The invention relates to a production logging tool and a downhole fluid analysis sensors vertical deploying method. Such a production logging tool is used to analyze a multiphase fluid mixture flowing from a hydrocarbon bearing zone into a hydrocarbon well. Such a production logging tool is particularly adapted to be deployed in a hydrocarbon well comprising deviated well sections, substantially horizontal well sections or a combination of the above. Production logging tools typically operate in the harsh downhole environment of hydrocarbon wells at downhole pressure (typically in the range of one hundred to 2000 bars) and temperature (typically in the range of 50 to 200° C.) conditions, and in possibly corrosive fluids.

BACKGROUND

During the production of a hydrocarbon well, it is necessary to monitor various characteristic parameters, like the relative volumetric flow rates of the different phases (e.g. oil, gas and water) of the multiphase fluid mixture flowing into the pipe of the well from the hydrocarbon bearing zones. Further, current hydrocarbon wells often comprise a vertical well section, deviated well sections and even substantially horizontal well sections. The interpretation of the flow in such complex wells is challenging because small changes in the well deviation and the flow regime influence the flow profile. Thus, an accurate monitoring requires sensors or probes capable of imaging a surface section or a volume section of the pipe and providing an estimation of the surface section or the volume section occupied by each phase.

Production logging of hydrocarbon wells (e.g., oil and gas wells) has numerous challenges related to the complexity of the multiphasic flow conditions and the harshness of the downhole environment.

Gas G, oil O, water W, mixtures O&W flowing in wells, being either openhole or cased hole wells, will present bubbles, droplets, mist, segregated wavy, slugs structures depending on the relative proportions of phases ("holdup"), their velocities, densities, viscosities, as well as pipe dimensions and well deviations. In order to achieve a good understanding of the individual phases flowrates and determine the relative contributions of each zone along the well, an accurate mapping of fluids types and velocities is required over the whole section of the hole (openhole well portion) or pipe (cased well portion) at different depths (i.e., the measured depth is different from the true vertical depth and generally longer than true vertical depth, due to deviations in the well from the vertical).

Further, production issues greatly vary depending on reservoir types and well characteristics resulting in the need for a flexible production logging technology working with different types of sensing physics. For example, due to the phases segregation, deviated wells showing high water cuts require an accurate detection of thin oil layer at the uppermost portion of the pipe. Well deviation will have a strong impact on velocities and holdups.

Furthermore, high pressure, up to 2000 bars, high temperature, up to 200° C., corrosive fluid ($H_2S$, $CO_2$) put constraints on sensors and tool mechanics.

Furthermore, solids presence in flowing streams can damage equipment. In particular, the sand entrained from reservoir rocks will erode parts facing the fluid flow. Solids precipitated from produced fluids due to pressure and temperature changes, such as asphalthenes, paraffins or scales create deposits contaminating sensors and/or blocking moving parts (e.g., spinners).

Furthermore, the tool deployment into the well can be difficult and risky. In highly deviated or horizontal wells, tools must be pushed along the pipe using coiled tubing or pulled using tractor which is difficult when tools are long and heavy. Pipes may be damaged by corrosion or rock stress which may create restrictions and other obstacles. During the logging operation, equipment can be submitted to high shocks. Thus, in such environments, it is highly preferable to have light and compact tools.

Furthermore, the cost is also an important parameter in order to provide an economically viable solution to well performance evaluation even in mature fields having low producing wells in process of depletion with critical water production problems.

Furthermore, measuring multiphase flow in substantially horizontal well sections (well axis YY') requires to resolve a layered flow within the well section. State of the art techniques rely on the deployment of an array of local sensors within the section of the hydrocarbon well 2. In a context of fully segregated flows G/O/W, an axial (more precisely the vertical direction—i.e. according to earth gravity vector—passing through the well axis YY') configuration AC as depicted in FIG. 2 achieves better spatial resolution over a radial configuration RC as depicted in FIG. 1 with the same number of measurement points MP. A part of Petrophysicist community has expressed a preference for such an axial configuration of measurements.

With respect to the hereinbefore described challenges, the state-of-the-art production logging tools, as described in document U.S. Pat. No. 7,114,386, have limitations. A particular production logging tool 1A comprises a one-dimensional (1D) array of sensors SP attached to an arm DA providing a scan of measurements along one line (vertical axis ZZ') of the well section as depicted in FIGS. 2 to 6. The body BD of the production logging tool is sitting at the bottom of the well conduit under its own weight. The arm DA is deployed from the body BD along the vertical axis ZZ' traversing the well section from top to bottom. This arm is used to hold sensors SP for phases identification and local velocity measurement. The sensors are simply attached to the arm. The angle between each sensor axis PP' and the horizontal axis YY' of the well (i.e., parallel to the longitudinal axis XX' of the production logging tool) is therefore dependent on actual opening of the arm as illustrated in FIGS. 3 to 6. Thus, the local sensors are generally (except for one particular configuration shown in FIG. 4) not perfectly positioned within the flow of multiphase fluid mixture to be measured. This may lead to incorrect measurements, resulting in poor measurement quality and even measurement errors.

SUMMARY OF THE DISCLOSURE

It is an object of the invention to propose a production logging tool that overcomes one or more of the limitations of the existing apparatus, in particular that is structurally simple and reliable to operate whatever the downhole conditions. Further, it is also a specific object of the invention to perform flow diagnostics in horizontal wells, with particular focus on large internal diameter hole (openhole well portion) or pipe (cased well portion).

According to one aspect, there is provided a production logging tool comprising an elongated cylindrical body of longitudinal axis, the body carrying an articulated dual arms deploying arrangement, at least one arm carrying at least one sensor to analyze at least one property of a multiphase fluid mixture flowing in a hydrocarbon well, said sensor extending along a sensor axis, the articulated dual arms deploying arrangement comprising two deploying arms and a sliding sleeve, the deploying arms being operable from a retracted configuration into a vertically extended configuration, the deploying arms being coupled together through an outermost end hinge at outermost ends of said deploying arms, one arm being coupled to a first end part of the body through a first hinge at another deploying arm end, and the other arm being coupled to a second end part of the body through a sliding sleeve hinge at the sliding sleeve at another deploying arm end, wherein the articulated dual arms deploying arrangement further comprises a pantographic mechanism arranged such that the sensor axis stays substantially parallel to the longitudinal axis for any opening of the deploying arms from the retracted configuration to the vertically extended configuration.

At least one deploying arm may comprise a pantograph upper arm rod and a pantograph lower arm rod, the pantograph upper arm rod being coupled to the body by a first hinge, the pantograph lower arm rod being coupled to the body by a second hinge, the pantograph upper and lower arm rods extending parallelly to each other, at least two sensor carrying rods being disposed and coupled along said pantograph upper and lower arm rods.

Each sensor carrying rod may comprise a first end connected to the pantograph upper arm rod by a third hinge, and a second end connected to the pantograph lower arm rod by a fourth hinge such as to connect the pantograph upper arm rod to the pantograph lower arm rod in an articulated manner, distances between, on the one hand, the first hinge and the second hinge, and, on the second hand, the third hinge and the fourth hinge being around the same.

The at least one sensor may be secured to a corresponding sensor carrying rod in a fixed manner such that a corresponding sensor axis is perpendicular to a sensor carrying rod axis, the sensor carrying rod being perpendicular to the tool body axis, and the sensor axis staying parallel to the tool body axis for any opening of the deploying arms from the retracted configuration to the vertically extended configuration.

At least one deploying arm may comprise a pantograph upper arm rod and one pantograph lower arm rod such that said deploying arm holds one row of sensors.

At least one deploying arm may comprise a pantograph upper arm rod and two pantograph lower arm rods positioned parallelly to each other, side by side, such that said deploying arm holds two rows of sensors.

The row of sensors may comprise a combination of phases identification sensors and local velocity measurements sensors.

Each pantograph upper arm rod may form a single piece having a semi cylindrical hollow shape comprising a longitudinal oblong opening arranged in an upper part, the first pantograph upper arm rod being connected to the second pantograph upper arm rod through the outermost end hinge at an outermost end of each pantograph upper arm rod.

Each pantograph upper arm rod may comprise two separated, parallelly extending, side by side, pantograph upper arm rod, the first pantograph upper arm rod being connected to the second pantograph upper arm rod through the outermost end hinge at an outermost end of each pantograph upper arm rod.

A first pantograph lower arm rod may be connected to a first left pantograph upper arm rod through sensor carrying rods all along its length, and a second pantograph lower arm rod may be connected to a first right pantograph upper arm rod through sensor carrying rods all along its length.

Each sensor may be secured to the sensor carrying rod by means of a metal strip and a screw, the sensor carrying rod comprising an appropriate threaded hole cooperating with said metal strip and screw to securely maintain in place the body of the sensor against the sensor carrying rod.

The first deploying arm may be nested with the second deploying arm at said outermost ends intended for contacting the wall of the well, both deploying arms being connected by means of the outermost end hinge and a roller, said roller being free to rotate about an axis of said outermost end hinge and protruding over said outermost ends of the deploying arms such that the roller enters into a frictional engagement with the wall of the hydrocarbon well.

According to a further aspect, there is provided a downhole fluid analysis sensors vertical deploying method comprising the steps of:

providing a production logging tool in a hydrocarbon well, the production logging tool comprising an elongated cylindrical body of longitudinal axis, the body carrying an articulated dual arms deploying arrangement, at least one arm carrying at least one sensor to analyze at least one property of a multiphase fluid mixture flowing in the hydrocarbon well, said sensor extending along a sensor axis, the articulated dual arms deploying arrangement comprising two deploying arms and a sliding sleeve, the deploying arms being operable from a retracted configuration into an vertically extended configuration, the deploying arms being arranged to deploy said sensor in a vertical plane passing through a well axis;

running the production logging tool along the hydrocarbon well while operating the deploying arms to vertically extend into engagement with a wall of the hydrocarbon well and to cause friction between said outermost ends of the deploying arms and the wall of the hydrocarbon well, said deploying arrangement being configured such that the sensor axis stays substantially parallel to the well axis for any vertical extension of the deploying arms when running the production logging tool along the hydrocarbon well.

The production logging tool of the invention enables deploying an array of local sensors along the vertical axis of a horizontal well section. Each local sensor positioning along the deploying arm is greatly improved by the operation of the pantographic mechanism allowing each local sensor to face the multiphase fluid mixture flowing in the hydrocarbon well independently of any diameter change of the well section. The pantographic mechanism results in a simple and compact structure achieving low cost, easy operation and maintenance.

Other advantages will become apparent from the hereinafter description of the invention.

DESCRIPTION OF THE DRAWINGS

The present invention is illustrated by way of examples and not limited to the accompanying drawings, in which like references indicate similar elements:

FIG. 1 is a cross-sectional view schematically illustrating a radial configuration of measurements in a horizontal section of a hydrocarbon well;

FIG. 2 is a cross-sectional view schematically illustrating an axial configuration of measurements in a horizontal section of a hydrocarbon well;

FIGS. 3 to 6 are side views schematically illustrating a one-dimensional array of sensors secured to an arm of a production logging tool according to the state-of-the-art in various deployed configurations and in a retracted configuration, respectively;

DETAILED DESCRIPTION OF THE INVENTION

Figure 7:
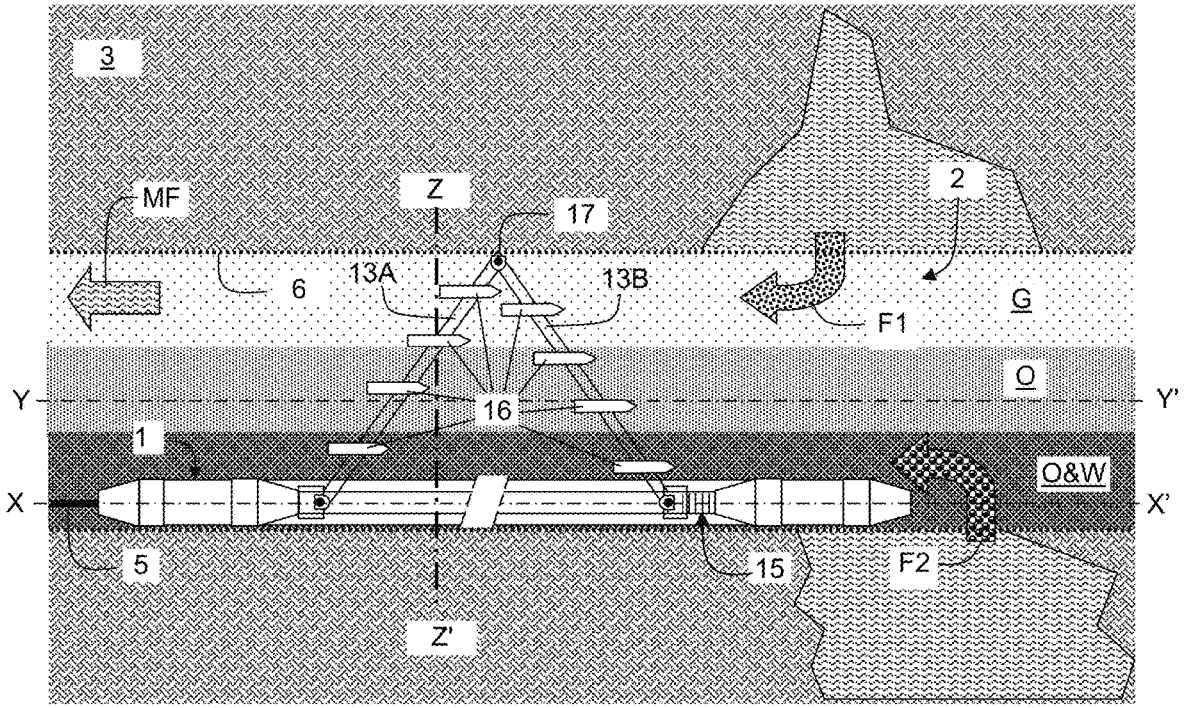
FIG. 7 is a side partial cross-sectional view illustrating a production logging tool of the invention within a horizontal well section in a fully deployed configuration.

FIG. 7 illustrates a downhole tool, for example a production logging tool 1 being deployed into a wellbore of a hydrocarbon well 2 that has been drilled into a subterranean formation 3. In this particular example, the downhole tool is deployed in a horizontal section of a hydrocarbon well that has been further fractured at defined locations (i.e. fracture clusters). The production logging tool 1 is used to analyze at least one property of a multiphase flow mixture MF flowing in the hydrocarbon well 2. The multiphase flow mixture MF is characterized by holdup, slippage velocity and phase segregation. Holdup is the percentage by volume of the gas, oil and/or water content in the wellbore measured over a cross-sectional area (based on the wellbore inner diameter). Slippage velocity is the relative velocity existing between light phases and heavy phase (light phases move faster than heavier phases). Phase segregation is the tendency of fluids to stratify into different layers because of differences in density between oil O, water W and gas G and due to the immiscibility of water and oil, and the limited miscibility (depending on temperature and pressure) of gas in oil and water. The wellbore refers to the drilled hole or borehole, including the open hole or uncased portion of the well. The borehole refers to the inside diameter of the wellbore wall, the rock face that bounds the drilled hole. The open hole refers to the uncased portion of a well. While most completions are cased, some are open, especially in horizontal wells where it may not be possible to cement casings efficiently. The production logging tool 1 is suitable to be deployed and run in the wellbore of the hydrocarbon well 2 for performing various analysis of the multiphase flow mixture MF properties irrespective of a cased or uncased nature of the hydrocarbon well. The production logging tool 1 may comprise various subsections having different functionalities and may be coupled to surface equipment through a wireline 5 (or alternative equipment such as coiled tubing) which is operable at a surface equipment to displace the tool along the well. At least one subsection comprises a measuring device generating measurements logs, namely measurements versus depth or time, or both, of one or more physical quantities in or around the well 2. Wireline logs are taken downhole, transmitted through the wireline 5 to surface and recorded there, or else recorded downhole and retrieved later when a logging instrument is brought to surface. There are numerous log measurements (e.g. electrical properties including conductivity at various frequencies, sonic properties, active and passive nuclear measurements, dimensional measurements of the wellbore, formation fluid sampling, formation pressure measurement, flow rate measurements, etc. . . . ) possible while the production logging tool 1 is displaced along and within the hydrocarbon well 2 drilled into the subterranean formation 3. Ancillary surface equipment is neither shown nor described in detail herein. In the following the wall of the wellbore irrespective of its cased (cement or pipe) or uncased nature is referred to wall 6. Various fluid (that may include solid particles) entries F1, F2 may occur from the subterranean formation 3 towards the wellbore 2. Once in the wellbore 2, these fluid entries form the multiphase flow mixture MF that generally flows towards the surface. In particular, in deviated or horizontal wells, the multiphase fluid mixture MF may be segregated. In a particular example, the segregated multiphase flow mixture MF may flow as a layer of gas G above a layer of oil O, further above a layer of immiscible oil and water mixture O&W from top to bottom (i.e. the vertical axis ZZ', in the direction of earth gravity).

Figure 8:
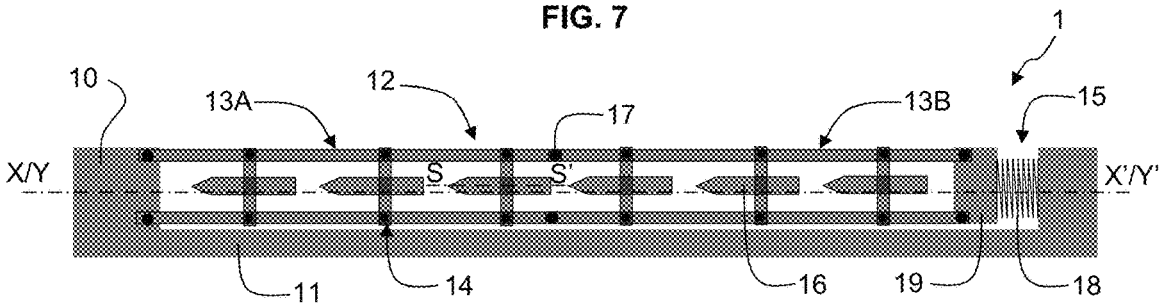
FIGS. 8 and 9 are side views schematically illustrating a one-dimensional array of sensors secured to a deploying arrangement of the production logging tool of the invention in a retracted configuration and in a partially deployed configuration, respectively.
Figure 9:
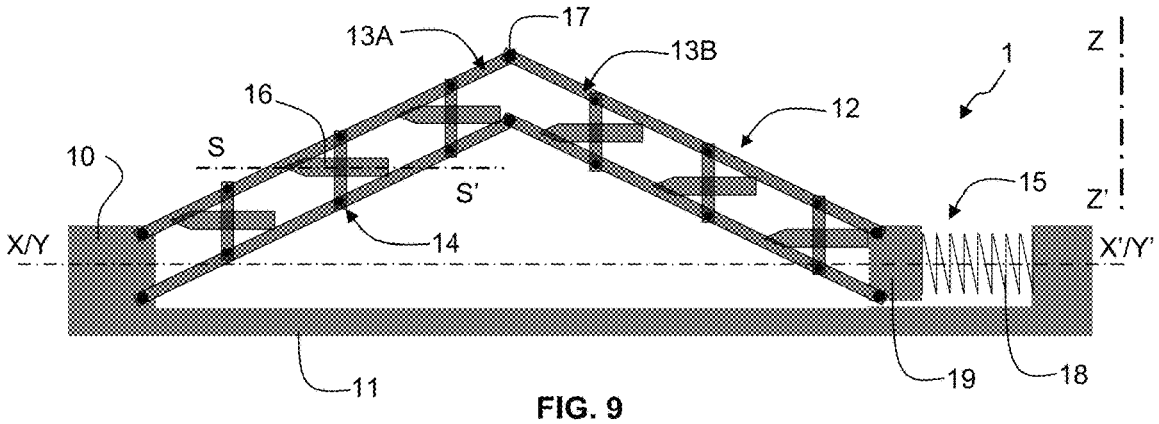

FIGS. 8 and 9 are side views schematically illustrating the production logging tool 1 of the invention. The production logging tool 1 has an elongated cylindrical shape and comprises a body 10 having a thinned central rigid portion 11 carrying an articulated dual arms deploying arrangement 12. The body 10 of the production logging tool 1 extends longitudinally about the longitudinal axis XX' that is coaxial with the well axis YY'. The body 10 of the production logging tool 1 is sitting at the bottom of the well under its own weight as depicted in FIG. 7. Alternatively, the production logging tool 1 may further comprise or be coupled to an additional weight in order to achieve better sitting, for example by means of a rotating swivel having eccentric weights (not shown). The articulated dual arms deploying arrangement 12 comprises two deploying arms 13A, 13B, a pantographic mechanism 14 and a sliding sleeve mechanism 15. The deploying arms 13A, 13B are deployed from the body 10 along the vertical axis ZZ' traversing the well section from bottom to top. More precisely, the weight distribution in the production logging tool 1 allows that the production logging tool is sitting at the bottom of the well section with a position and orientation such that the two deploying arms 13A, 13B can extend from the tool body 10 towards the top according to the vertical direction (vertical axis ZZ', i.e. the vertical axis ZZ' is defined by the earth gravity vector) and passing through the well axis YY' (see the measurements configuration depicted in FIG. 2). Optionally, the production logging tool 1 may also comprise a triaxial accelerometer for controlling inclination and relative bearing in order to check whether or not the production logging tool 1 is correctly positioned/deployed in the well section to be measured. The deploying arms 13A, 13B are coupled together through a hinge 17 at an outermost end, one arm 13A is coupled to a first end part of the body 10 through a hinge at another end, and the other arm 13B is coupled to a second end part of the body through a hinge at the sliding sleeve mechanism 15 at another end. The sliding sleeve mechanism 15 may comprise an axial spring 18 extending along the longitudinal axis XX' and being disposed in abutment between the second end part of the body and a sliding sleeve 19. The other arm 13B is coupled through a hinge at said sliding sleeve. The sliding sleeve mechanism 15 comprising the axial spring 18 is a passive mechanism enabling the deploying arms 13A, 13B to be automatically vertically extended such as to be deployed in the full well diameter and to engage the wall of the well as depicted in FIG. 7. Alternatively, the passive sliding sleeve mechanism 15 may be replaced by an active motorized mechanism, for example a motor (not shown) replacing the spring and controlling the position of the sliding sleeve. Each deploying arm 13A, 13B may be holding sensors 16 for example for phases identification and local velocity measurements. Alternatively, only one deploying arm 13A or 13B may be holding said sensors 16. The sensor 16 may include a sensing part, an electronic part and input/output wire so as to provide numerical measurement data, these ancillary sensor components and their operations are neither shown nor described in detail herein. Though, FIGS. 11 to 17 only illustrate a non-limitative embodiment comprising micro-spinners used to measured velocity and direction of flow and electrical phases identification sensors on both deploying arm 13A, 13B, the array of sensors 16 may be of any type or a combination of multiple types.

FIG. 9 shows a partial or fully deployed configuration while FIG. 8 shows a retracted configuration. The articulated dual arms architecture enables a fully open configuration of the production logging tool within the well diameter through the operation of the two deploying arms 13A, 13B and the sliding sleeve mechanism 15. The outermost end of the deploying arms 13A, 13B may contact the wall 6 of the wellbore during measurement operations in the wellbore (e.g. through a roller 25, see FIG. 11). In this way, the production logging tool 1 is stabilized in the wellbore section being under measurements. Further, when the production logging tool 1 is moved along the wellbore, the deploying arrangement 12 is automatically adapted to fit through borehole sections of different diameters.

The sensors 16 are attached to the deploying arm 13A, 13B by means of the pantographic mechanism 14 such that the sensor axis SS' is always substantially parallel to, generally co-axial with the tool axis XX' (i.e. accordingly, also the well axis YY') whatever the actual opening (lateral extension) of the deploying arms 13A, 13B as illustrated in FIGS. 7 to 10. The pantographic mechanism 14 allows sensors 16 to stay aligned within the flow. Thus, each local sensor axis SS' is always perfectly positioned within the flow of multiphase fluid mixture to be measured.

Figure 10:
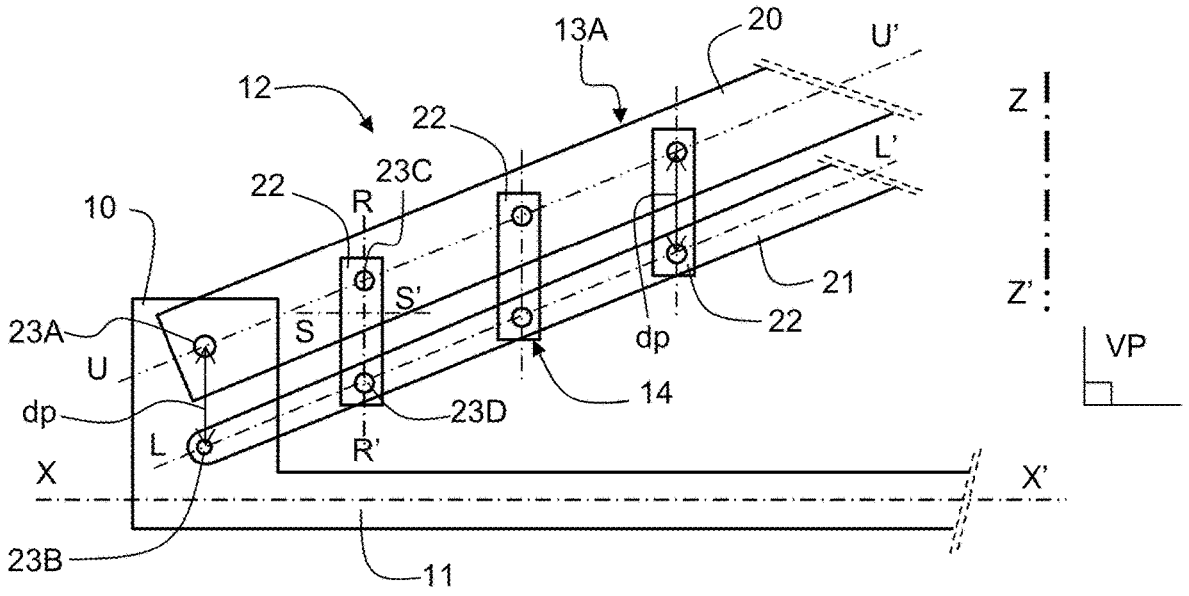
FIG. 10 is a side view schematically illustrating the operation principle of a pantographic mechanism of the deploying arrangement of the production logging tool of the invention.

FIG. 10 is a side view schematically illustrating the operation principle of the pantographic mechanism 14 of the production logging tool 1. Each deploying arm 13A, 13B (only 13A is shown in FIG. 10) comprises a pantograph upper arm rod 20 and a pantograph lower arm rod 21. The pantograph upper arm rod 20 is coupled to the body 10 by a first hinge 23A. The pantograph lower arm rod 21 is coupled to the body 10 by a second hinge 23B. The pantograph upper arm rod 20 and the pantograph lower arm rod 21 extend in a parallel fashion according to their respective axis UU', respectively LL'. Multiple sensor carrying rods 22 (one would be sufficient to achieve the pantographic mechanism) are disposed and coupled along said pantograph upper and lower arm rods 20, 21. Each sensor carrying rod 22 comprises a first end connected to the pantograph upper arm rod 20 by a third hinge 23C, and a second end connected to the pantograph lower arm rod 21 by a fourth hinge 23D. Each measurement sensor 16 is not directly attached to the arms but, instead, attached to a corresponding sensor carrying rod 22 in a fixed manner such that the corresponding sensor axis SS' is perpendicular to the sensor carrying rod axis RR'. Thus, the sensor carrying rods 22 have two functions, a first function is to support sensors 16, and a second simultaneous function is to connect the pantograph upper arm rod 20 to the pantograph lower arm rod 21 in an articulated manner. The distances "dp" between, on the one hand, the first hinge 23A and the second hinge 23B, and, on the second hand, the third hinge 23C and the fourth hinge 23D are around the same. In other word, the first hinge 23A and the third hinge 23C are disposed on pantograph upper arm rod axis UU', while the second hinge 23B and the fourth hinge 23D are disposed on the pantograph lower arm rod 21 axis LL'. Each sensor carrying rod 22 is positioned according to the same fashion all along the pantograph upper and lower arm rods 20, 21. Thanks to this configuration, the sensor carrying rod 22 always stay vertical with reference to tool body 11 (i.e., perpendicular to the tool body axis XX') and the sensor axis SS' always stays horizontal with reference to the thinned central rigid portion 11 (i.e., parallel/co-axial to the tool body axis XX'). Further, the sensors are deployed in a vertical plane VP passing through the well axis YY'. Thus, an optimal positioning of each sensor along the deploying arm is achieved while deployment of the production logging tool within the well occurs and causes the production logging tool to follow the changes of internal diameter of the hydrocarbon well (cased or openhole). FIG. 10 only shows the deploying arm 13A. The other deploying arm 13B is similar except for the coupling to the tool body 10 by means of the sliding sleeve mechanism 15 instead of a direct coupling to the tool body 10.

FIGS. 11 to 21 illustrates a particular embodiment of the production logging tool of the invention. In this particular embodiment, each deploying arm 13A, 13B comprises a single pantograph upper arm rod 20A, 20B having a semi cylindrical and opened shape and two pantograph lower arm rods 21A, 21B positioned parallelly to each other such that each deploying arm 13A, 13B holds two rows of sensors 16. Further, in this particular embodiment, the two rows 31A, 32A associated with deploying arm 13A comprise a combination of phases identification sensors and local velocity measurements sensors, e.g., mini-spinner, and the two rows 31B, 32B associated with deploying arm 13B comprise only phases identification sensors (all the rows are better seen in FIG. 13).

Figure 11:
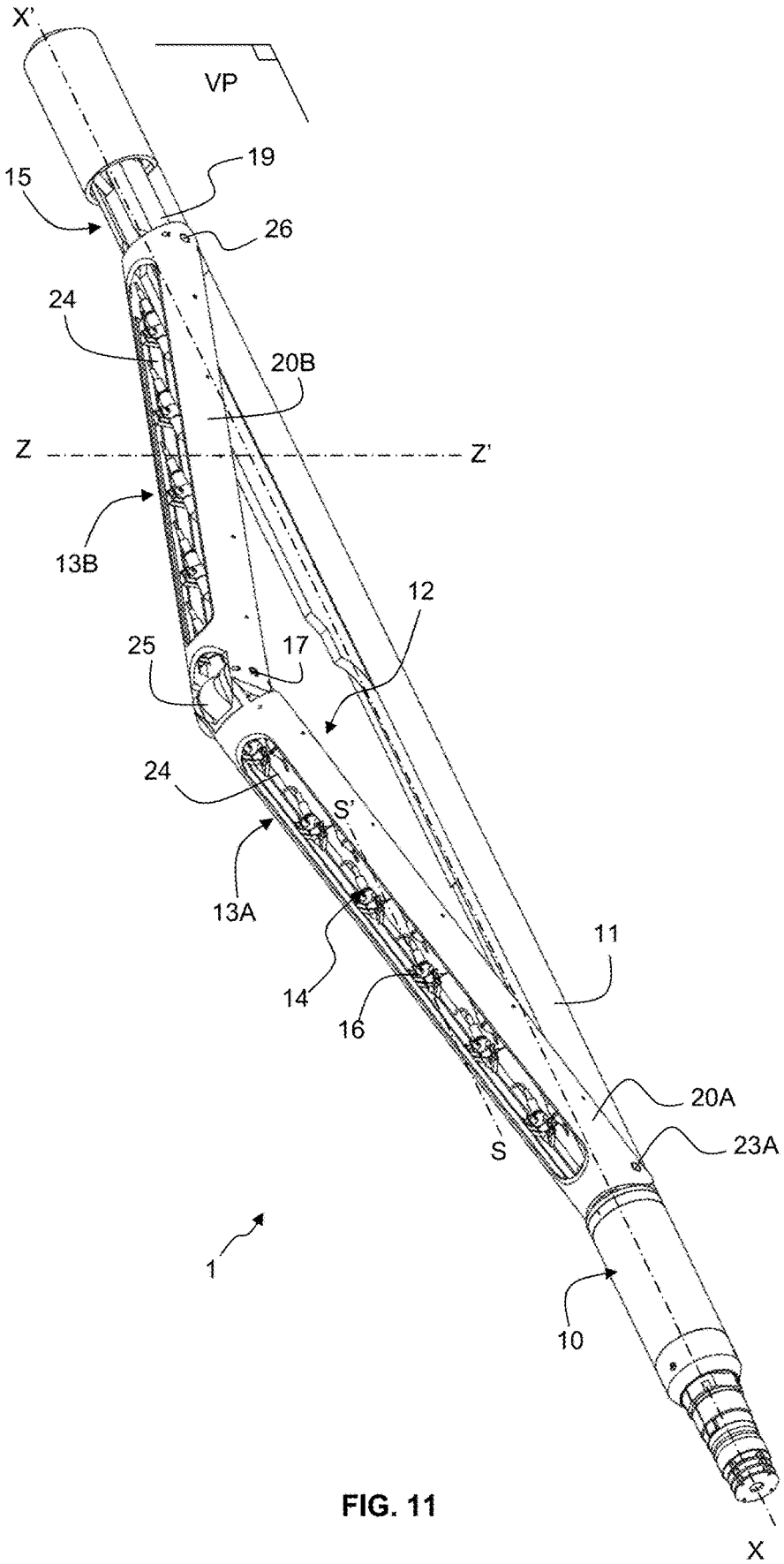
FIGS. 11 to 15 are, respectively, a one side perspective view, a side view, an upper view, a cross-sectional side view (along line AA of FIG. 15) and a front view of a particular embodiment of the production logging tool of the invention in a partially deployed configuration.
Figure 12:
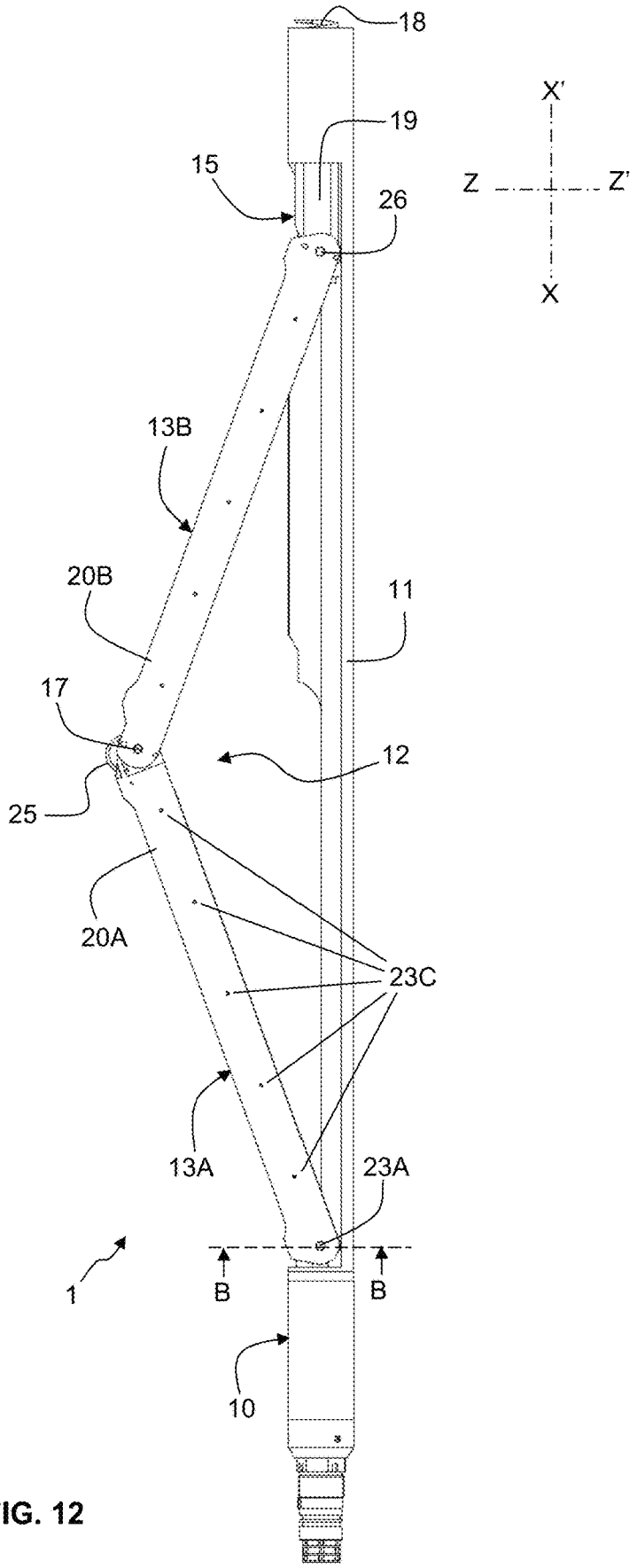
Figure 13:
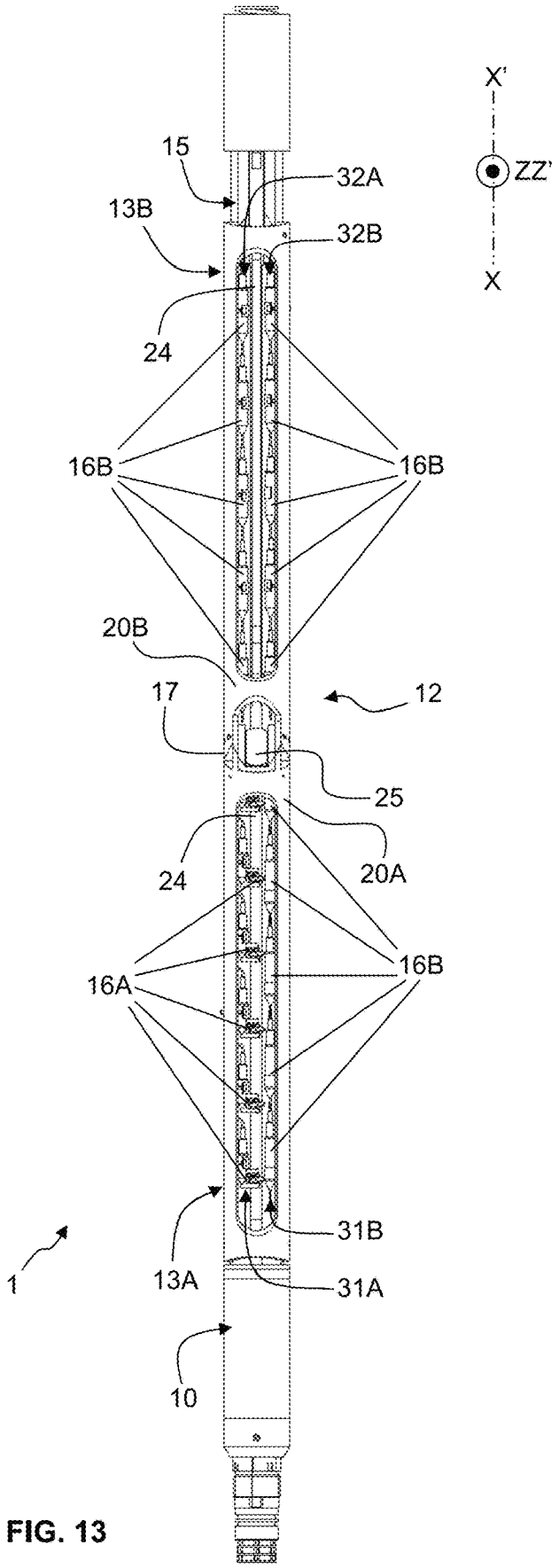
Figure 14:
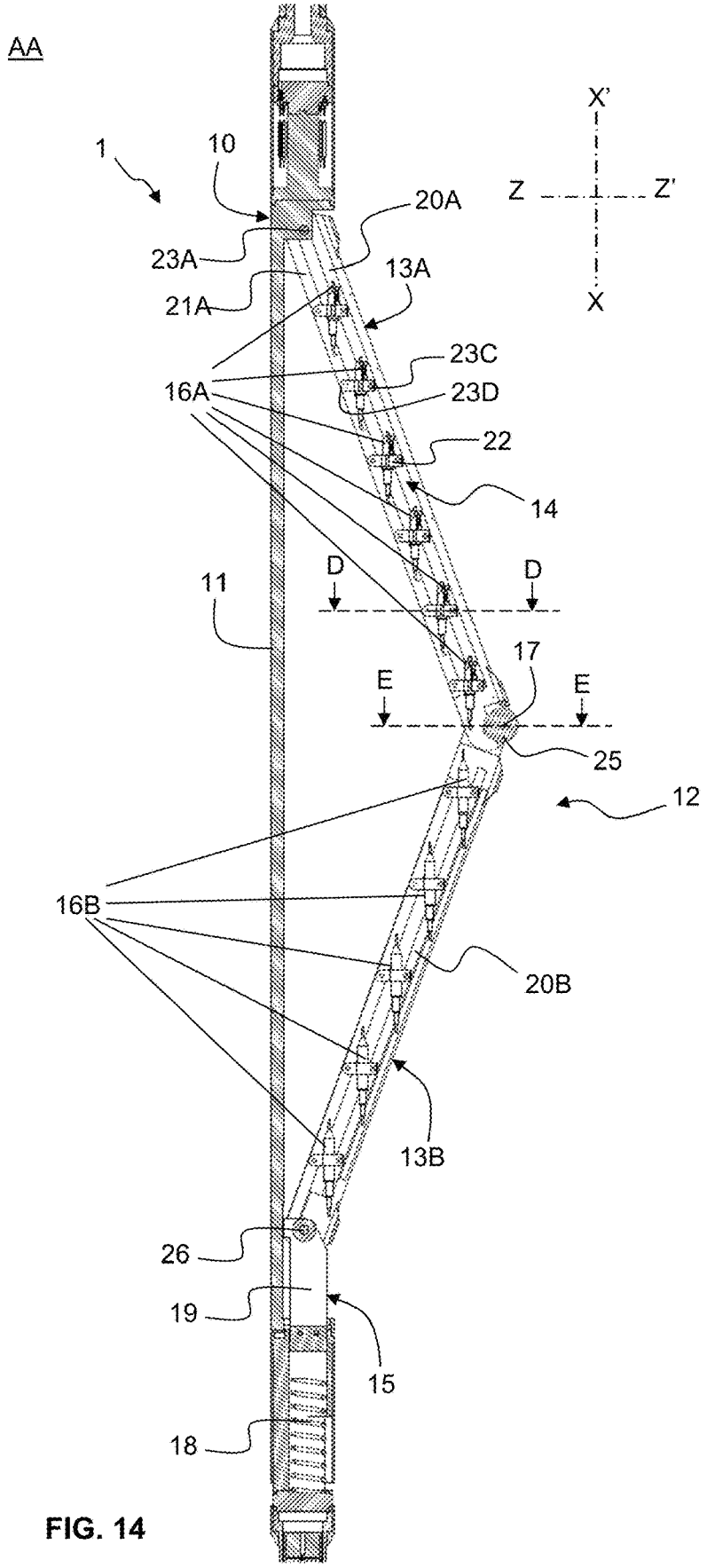
Figure 15:
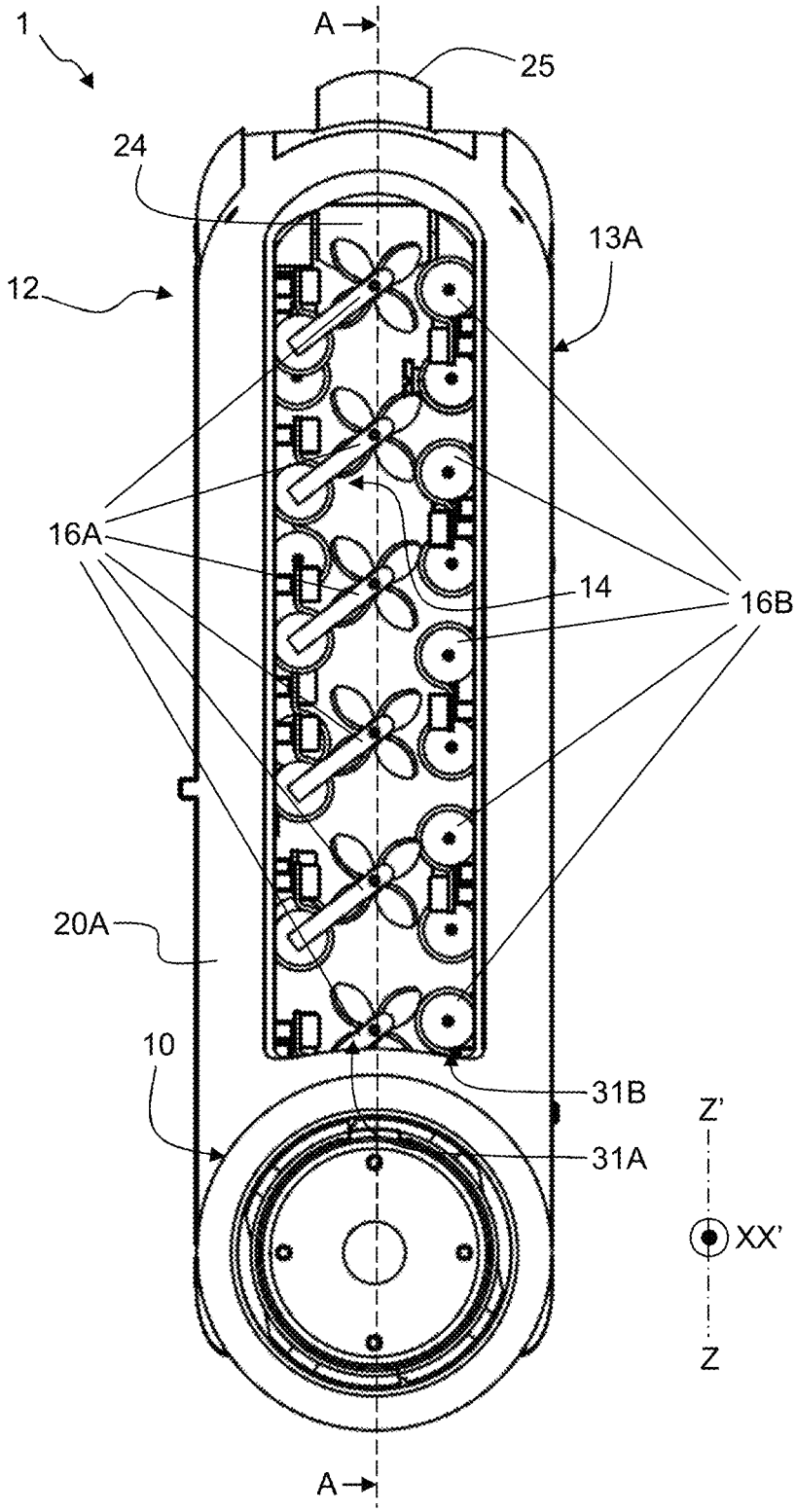

FIG. 11 is a one side perspective view of the production logging tool in a partially deployed configuration. FIG. 12 is a side view of the production logging tool in a partially deployed configuration. FIG. 13 is an upper view of the production logging tool in a partially deployed configuration. FIG. 14 is a cross-sectional side view along line AA of FIG. 15 of the production logging tool in a partially deployed configuration. FIG. 15 is a front view of the production logging tool in a partially deployed configuration. FIG. 11 particularly shows the pantograph upper arm rod 20A associated with the deploying arm 13A and the pantograph upper arm rod 20B associated with the deploying arm 13B. Each of these pantograph upper arm rods 20A and 20B has a semi cylindrical hollow shape (hollow half tube) comprising a longitudinal oblong opening 24 arranged in an upper part. The first pantograph upper arm rod 20A is connected to the second pantograph upper arm rod 20B through the outermost end hinge 17 at an outermost end of each pantograph upper arm rod 20A, 20B. The first pantograph upper arm rod 20A is connected to the first end part of the body 10 through the first hinge 23A at another end. The first hinge 23A comprises a pin that is fully crossing through first end part of the body 10 and through both sides of the pantograph upper arm rod 20A at said another end as can be better seen in FIG. 16. The second pantograph upper arm rods 20B is connected to the sliding sleeve 19 of the sliding sleeve mechanism 15 through a sliding sleeve hinge 26 at another end. Though not depicted, the sliding sleeve hinge 26 is similar to the first hinge 23A.

Figure 16:
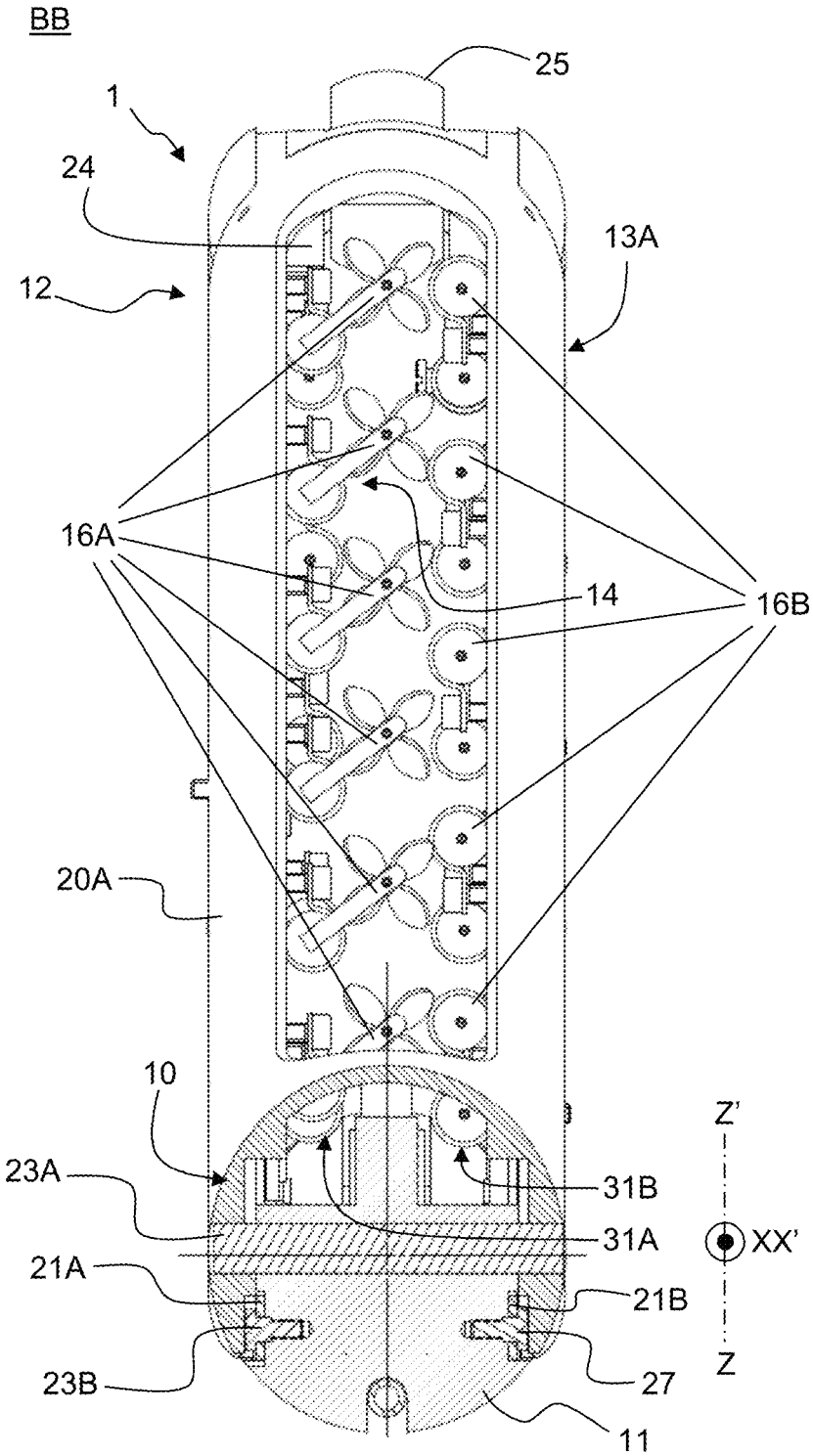
FIG. 16 is a partial cross-sectional and front view (along line BB of FIG. 12) illustrating the coupling of the pantographic mechanism to the body of the production logging tool of the invention.

FIG. 16 is a partial cross-sectional and front view along line BB of FIG. 12. FIG. 16 particularly shows the coupling of the pantographic mechanism to the body of the production logging tool of the invention.

Figure 17:
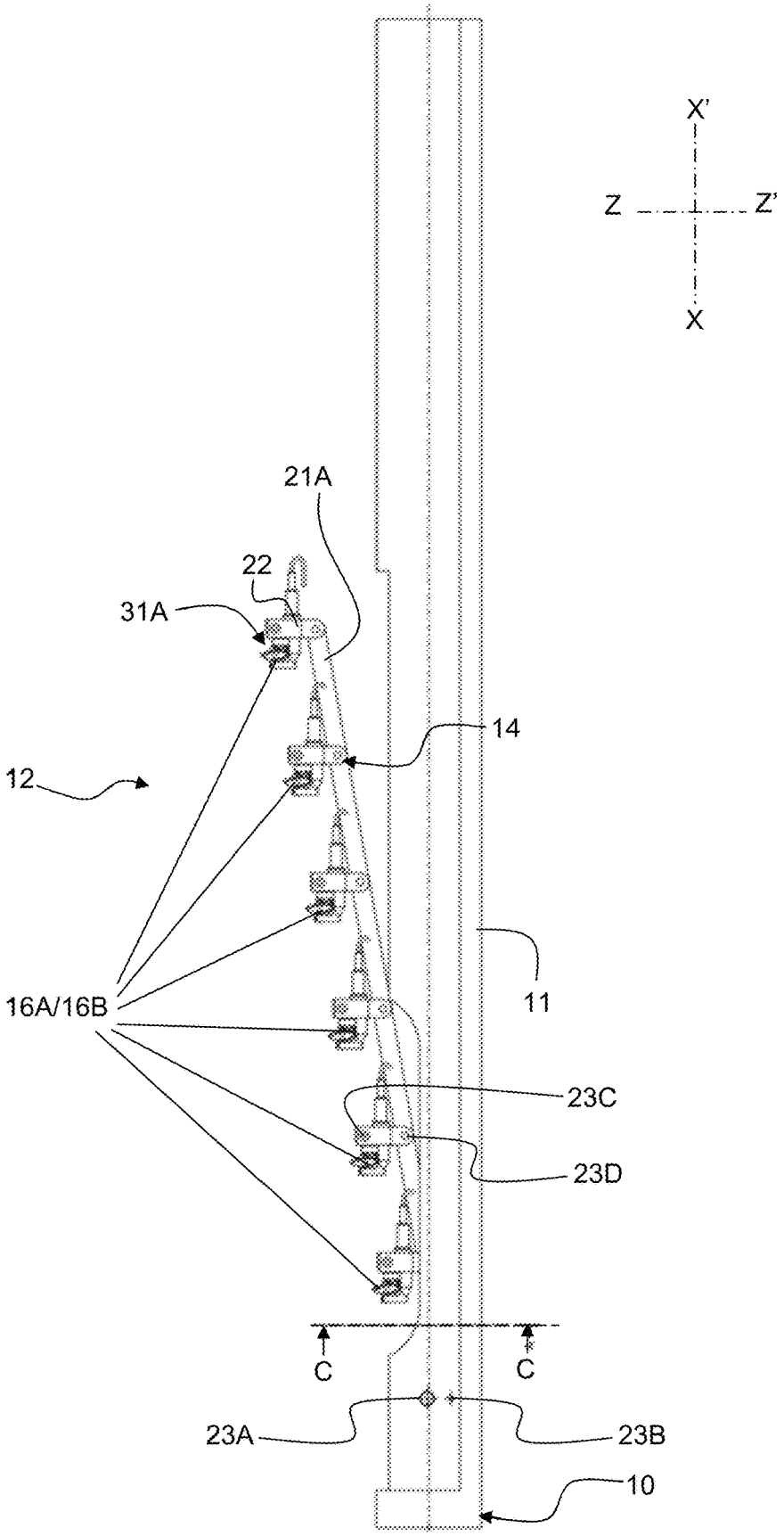
FIGS. 17 to 19 are, respectively, a side view, an upper view and a partial cross-sectional and front view (along line CC of FIG. 17) of the particular embodiment of the production logging tool of the invention in a partially deployed configuration where the deploying arm has been omitted to illustrate the internal arrangement of the pantographic mechanism, the sensors and the coupling to the body.
Figure 18:
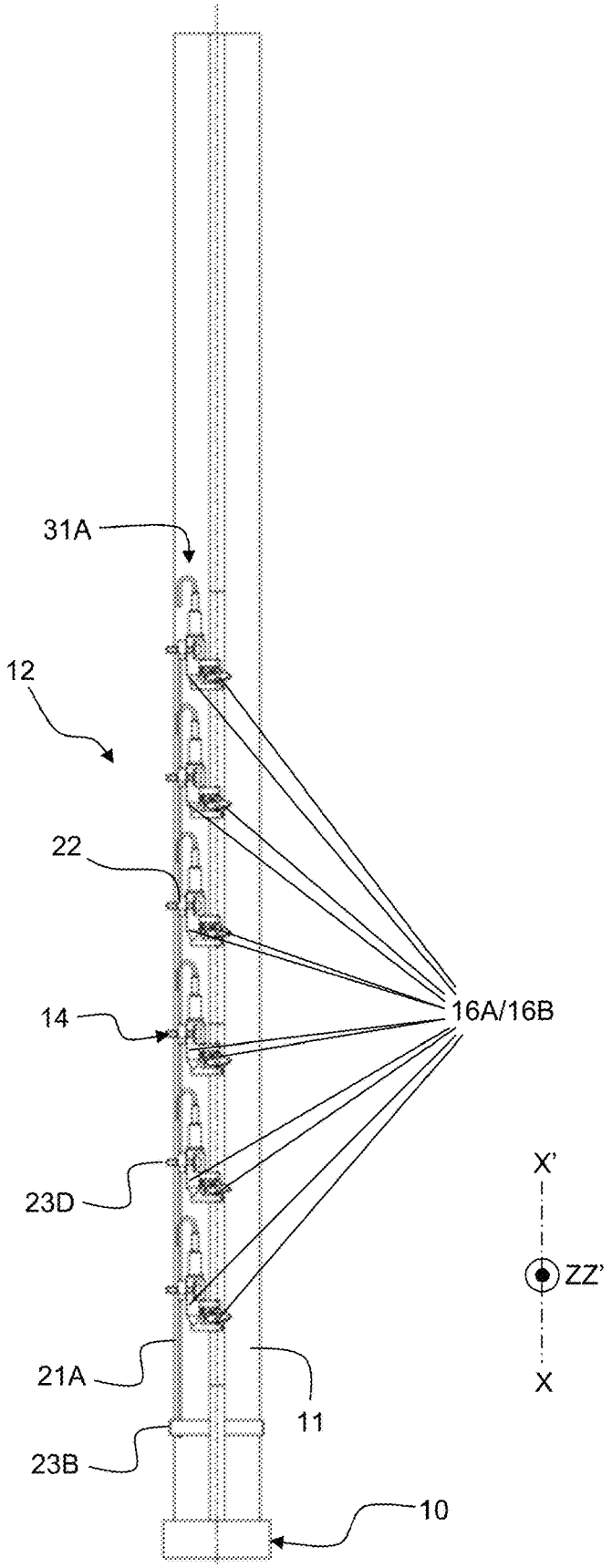
Figure 19:
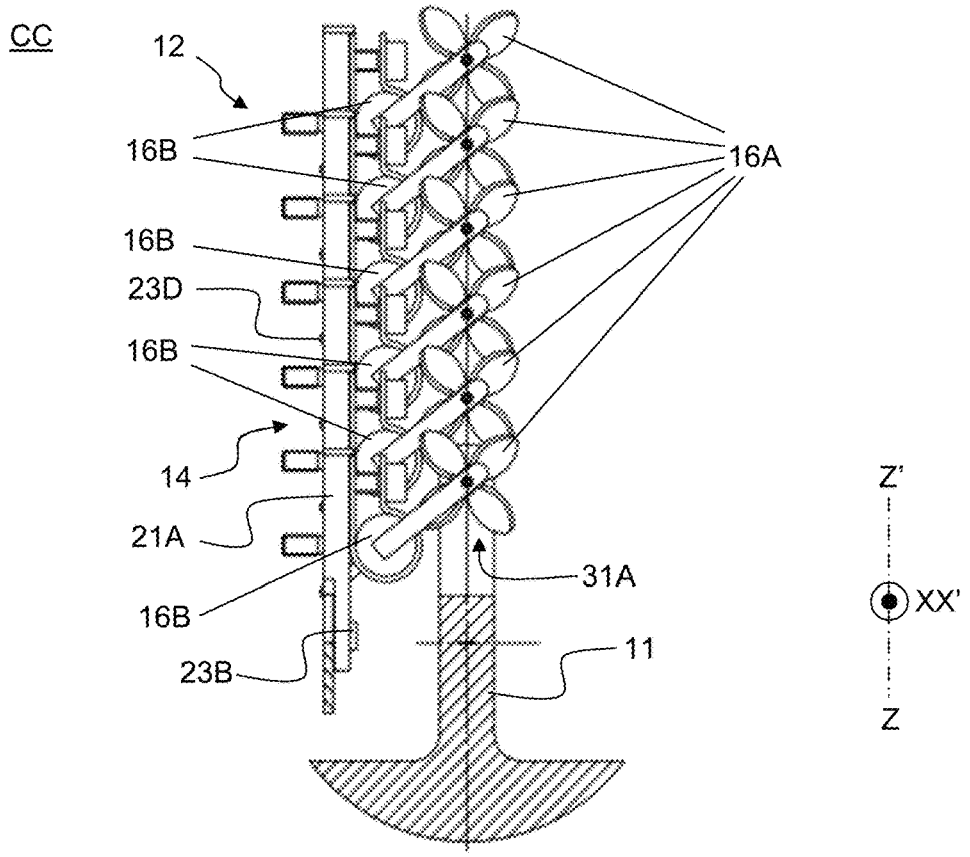

FIG. 17 is a side view and FIG. 18 is an upper view of the production logging tool in a partially deployed configuration. FIG. 19 is a partial cross-sectional and front view along line CC of FIG. 17 of the production logging tool in a partially deployed configuration. In these FIGS, the pantograph upper arm rod 20A associated with the deploying arm 13A has been omitted and only the first pantograph lower arm rods 21A is shown in order to illustrate the internal arrangement of the pantographic mechanism, the sensors and the coupling to the body. Further, only the pantograph lower arm rods 21A associated with the first row 31A of sensors is shown.

The first pantograph lower arm rod 21A is connected to the first pantograph upper arm rod 20A (not shown) through the sensor carrying rods 22 all along its length. The first pantograph lower arm rod 21A is connected to the first end part of the body 10 through the second hinge 23B at one end. The other end (outermost end) of the first pantograph lower arm rod 21A is free. The second hinge 23B comprises a pin that is inserted through a first end part of the body 10 and through the pantograph lower arm rod 21A at said end as can be better seen in FIG. 16. In the particular example depicted in FIG. 16, the pin comprises a head for blocking the lateral movement of the pantograph lower arm rod 21A, a smooth part enabling free rotation of the pantograph lower arm rod 21A and a threaded part securing the pin into a corresponding threaded hole of the first end part of the body 10.

FIGS. 17-19 only show the deploying arm 13A and one row (i.e., the first row 31A) of sensors for sake of clarity. The pantograph lower arm rod 21B associated with the second row 31B of sensors is connected to the first end part of the body 10 through a hinge 27 that is similar to the second hinge 23B (only visible in FIG. 16). The other deploying arm 13B is similar except for the coupling to the tool body 10 by means of the sliding sleeve mechanism 15 instead of a direct coupling to the tool body 10. The other pair of pantograph lower arm rods (not shown) are connected to the sliding sleeve 19 of the sliding sleeve mechanism 15 through hinges at another end. Though not depicted, these hinges associated with the other pair of pantograph lower arm rods are similar to the hinges 23A and 17.

Figure 20:
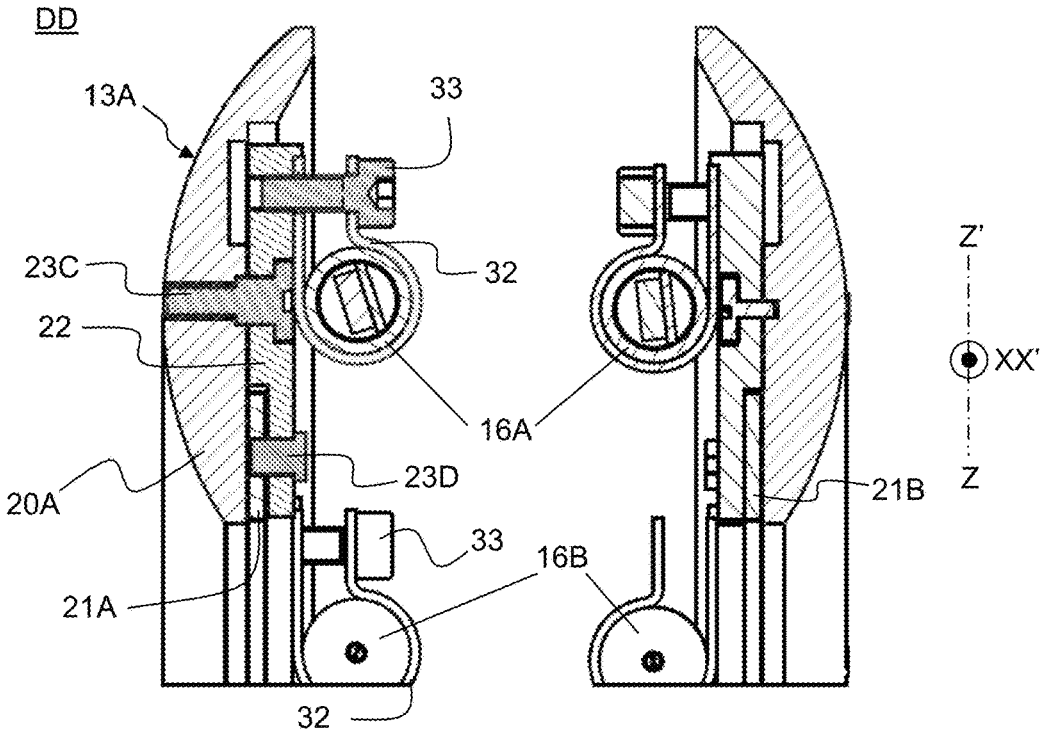
FIG. 20 is a partial cross-sectional and front view along line DD of FIG. 14.
Figure 21:
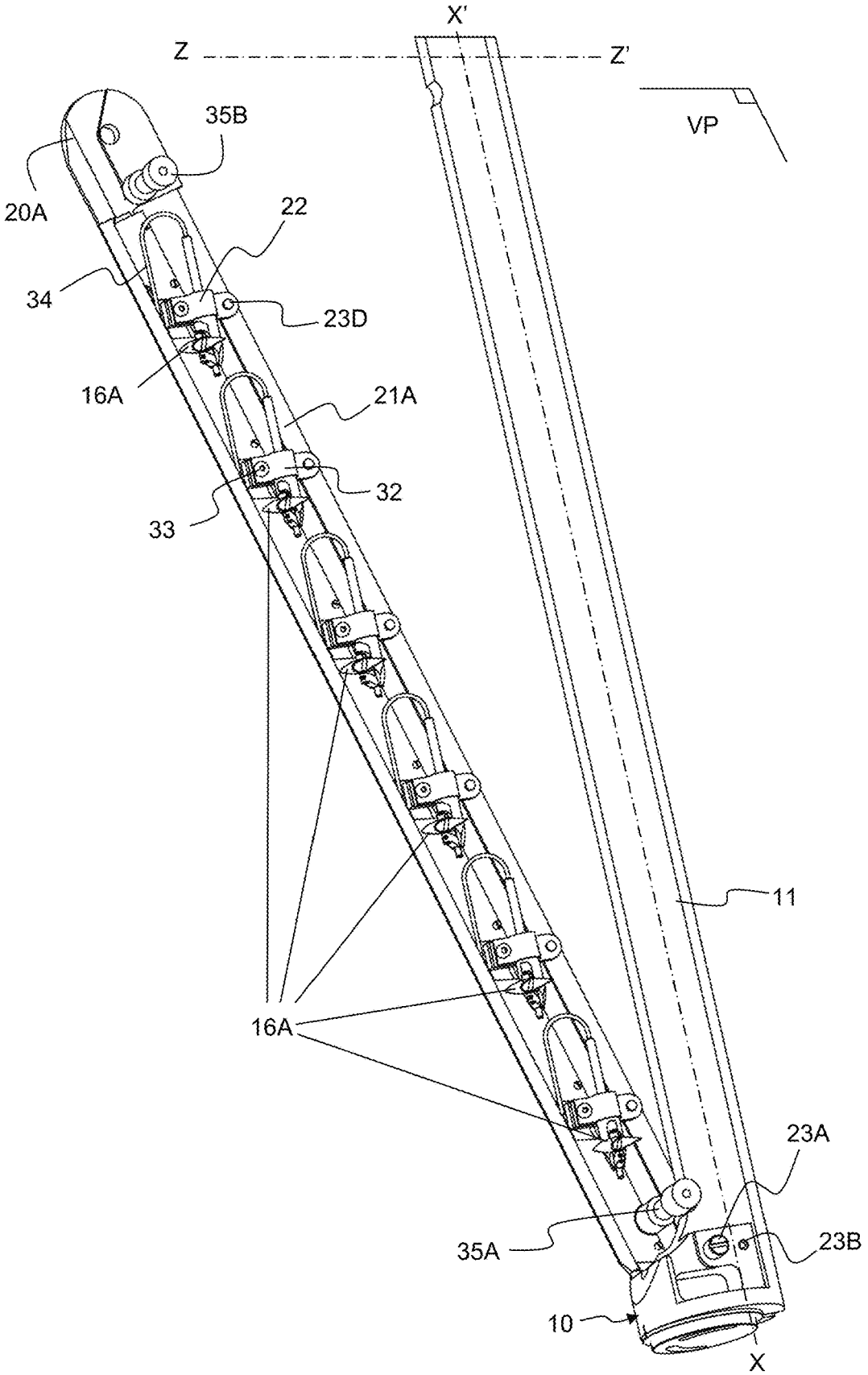
FIG. 21 is partial side perspective view, both illustrating the sensors fastening to the pantographic mechanism of the production logging tool of the invention.

FIG. 20 is a partial cross-sectional and front view along line DD of FIG. 14, and FIG. 21 is partial side perspective view illustrating the sensors fastening to the pantographic mechanism of the production logging tool of the invention. Concerning FIG. 21, like in FIGS. 17 to 19, some elements have been omitted or partially depicted (e.g. only a portion of pantograph upper arm rod 20A is visible) for sake of clarity, and only the first pantograph lower arm rods 21A is shown in order to illustrate the fastening of the sensors. Each sensor 16A, 16B is secured to the sensor carrying rod 22 by means of a metal strip 32 and a screw 33. The sensor carrying rod 22 comprises an appropriate threaded hole cooperating with the metal strip 32 and the screw 33 to securely maintain in place the body of the sensor 16A, 16B against the sensor carrying rod while permitting an easy mounting and dismantling. Other way of fastening the sensor to the sensor carrying rod 22, like welding or clipping may also be possible. Each sensor 16A is coupled to production logging tool electronics (not shown) with an appropriate input/output wire 34. Further, a lower abutment rod 35A and an upper abutment rod 35B, both extending perpendicularly to the pantograph upper arm rod axis may be fitted in order to block the rotational movement of the arm against the thinned central rigid portion 11.

Figure 22:
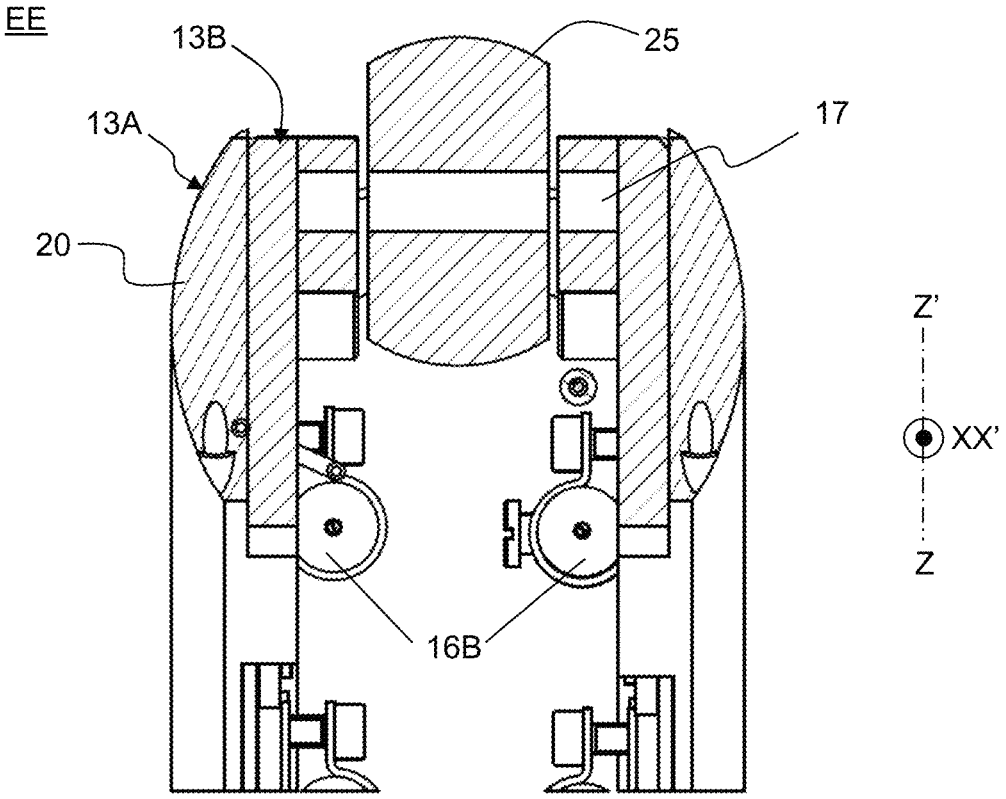
FIG. 22 is a partial cross-sectional and front view along line EE of FIG. 14 illustrating an outermost end hinge at outermost ends of the deploying arms of the production logging tool of the invention.

FIG. 22 is a partial cross-sectional and front view along line EE of FIG. 14 illustrating the outermost end hinge 17 at outermost ends of the deploying arms 13A, 13B of the production logging tool of the invention. The first deploying arm 13A is nested with the second deploying arm 13B at said outermost ends intended for contacting the wall of the well. Both deploying arms 13A, 13B are connected by means of the outermost end hinge 17 and a roller 25. Said outermost ends of the deploying arms 13A, 13B are arranged such as to form a central and hollow part wherein said roller is free to rotate. The roller 25 is arranged to be free to rotate about the axis of the outermost end hinge 17. The roller 25 protrudes over said outermost ends of the deploying arms 13A, 13B such that the roller 25 enters into a frictional engagement with the wall of the well. The roller 25 is arranged to withstand the contact and displacement all along the wall of the well (cased or uncased).

Figure 23:
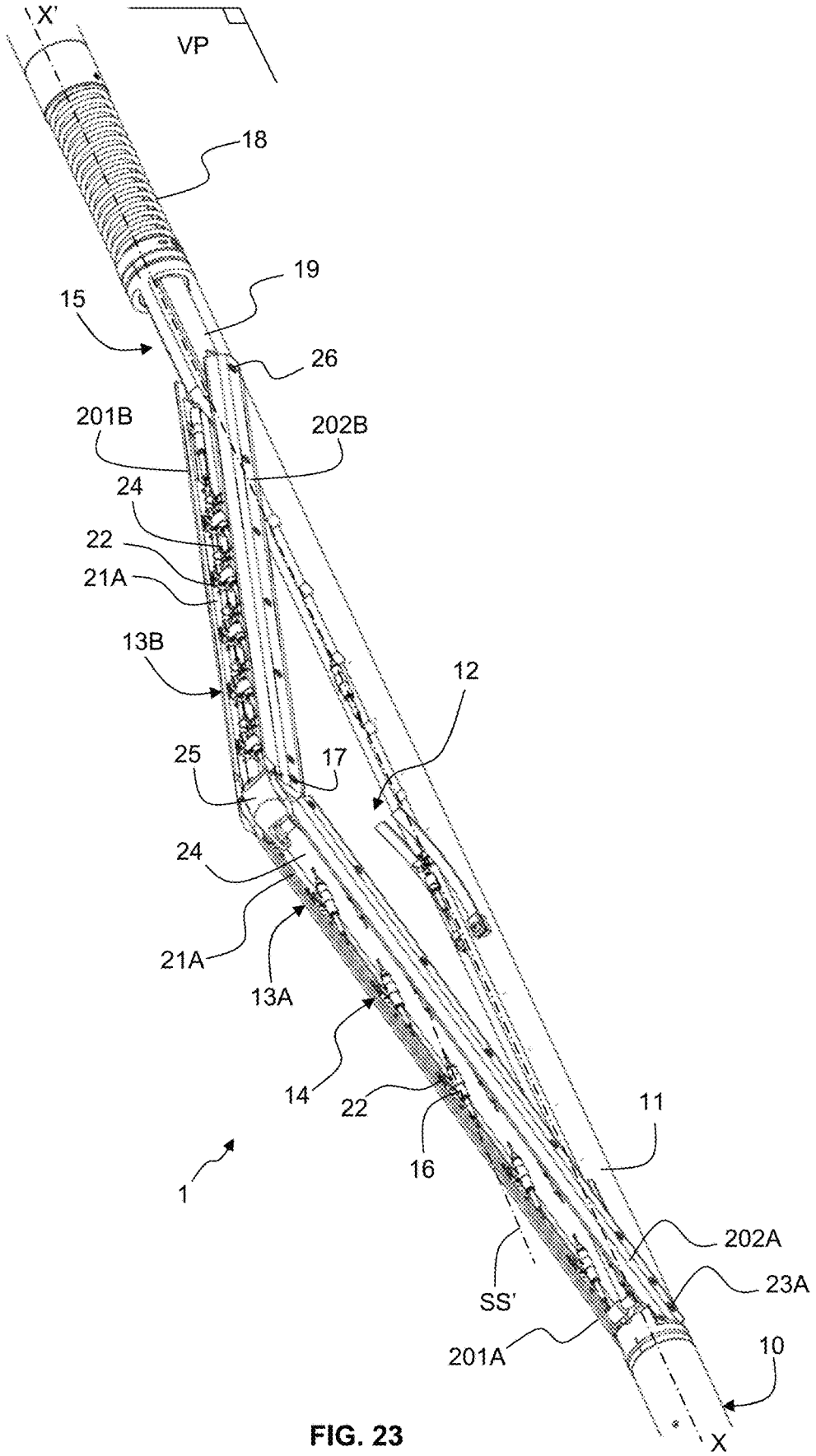
FIG. 23 is a one side perspective view of another particular embodiment of the production logging tool of the invention in a partially deployed configuration.

FIG. 23 illustrates another particular embodiment of the production logging tool of the invention according to a one side perspective view. The production logging tool of the invention is shown in a partially deployed configuration. This embodiment differs from the one of FIG. 11 in that the single pantograph upper arm rod 20A (and 20B) having a semi cylindrical and opened shape is replaced by two separate, parallelly extending, side by side, first left and right pantograph upper arm rod 201A, 202A (and two separate, parallelly extending, side by side, second left and right pantograph upper arm rod 201B, 202B, respectively). The longitudinal opening 24 is defined by the space between two parallelly extending left and right pantograph upper arm rod 201A, 202A (and 201B, 202B, respectively). In the depicted example, each deploying arm 13A, 13B holds two rows 31A, 31B, respectively 32A, 32B (visible on FIG. 13) of sensors 16. The first row 31A, respectively 32A is associated with the left pantograph upper arm rod 201A, respectively 201B. The second row 31B, respectively 32B is associated with the right pantograph upper arm rod 202A, respectively 202B. The first pantograph lower arm rod 21A is connected to the first left pantograph upper arm rod 201A through the sensor carrying rods 22 all along its length. The second pantograph lower arm rod 21B (not visible) is connected to the first right pantograph upper arm rod 202A through the sensor carrying rods 22 all along its length. The first left and right pantograph upper arm rod 201A, 202A are connected to the second left and right pantograph upper arm rod 201B, 202B through the outermost end hinge 17 at an outermost end of the pantograph upper arm rods 201A, 202A and 201B, 202B. The left and right pantograph upper arm rod 201A, 202A are connected to the first end part of the body 10 through the first hinge 23A at another end. The second left and right pantograph upper arm rod 201B, 202B are connected to the sliding sleeve 19 of the sliding sleeve mechanism 15 through the sliding sleeve hinge 26 at another end.

With the production logging tool of the invention, it is possible to achieve:

- Perfect alignment of sensor array with well axis, each sensor facing the flow in an optimal configuration.
- Fluid identification measurements can be focused on area of pipe section with most interest such as phases interfaces for accurate holdups imaging.
- Velocity measurements can be focused on area of pipe section with minimal perturbations, in the bulk of phases away from interfaces.
- Minimal perturbation of flow from tool structure is obtained thanks to the original mechanical structure of the tool.
- Interchangeable sensors in order to adapt to specific production issues or maintenance issues.
- Design compatible with all types of sensor/probe such as electrical, optical, ultrasonic, high resolution temperature, conductive, capacitive, optical reflection, optical fluorescence, active ultrasonics, passive ultrasonics, flow sensors, etc. . . .
- Robust design allowing deployment in openhole sections.
- Operation in memory mode for operations where electrical cable telemetry is not available such as coiled tubing deployment.

The production logging tool structure of the invention is simple, compact achieving low cost and easy operation and maintenance.

It should be appreciated that embodiments of the production logging tool according to the present invention are not limited to the embodiment showing horizontal hydrocarbon well bore, the invention being also applicable whatever the configuration of the well bore, namely deviated or a succession of deviated and/or horizontal portions, cased or uncased. Also, the deploying arrangement of the invention is not limited to an application into a production logging tool, but can be easily adapted to various applications into analysis tools operating at downhole pressure and temperature conditions, e.g. a downhole fluid analysis tool, a wireline tool, a formation tester. Despite the fact that the illustrated production logging tool comprises only a unique measuring section, the principle of the invention would be equally applicable to a production logging tool comprises multiple measuring sections coupled together.

The invention claimed is:

1. A production logging tool comprising an elongated cylindrical body of longitudinal axis, the body carrying an articulated dual arms deploying arrangement, at least one arm carrying at least one sensor to analyze at least one property of a multiphase fluid mixture flowing in a hydrocarbon well, said sensor extending along a sensor axis, the articulated dual arms deploying arrangement comprising two deploying arms and a sliding sleeve, the deploying arms being operable from a retracted configuration into a vertically extended configuration, the deploying arms being coupled together through an outermost end hinge at outermost ends of said deploying arms, one arm being coupled to a first end part of the body through a first hinge at another deploying arm end, and the other arm being coupled to a second end part of the body through a sliding sleeve hinge at the sliding sleeve at another deploying arm end, wherein the articulated dual arms deploying arrangement further comprises a pantographic mechanism arranged such that the sensor axis stays substantially parallel to the longitudinal axis for any opening of the deploying arms from the retracted configuration to the vertically extended configuration, wherein at least one deploying arm comprises a pantograph upper arm rod and a pantograph lower arm rod, the pantograph upper arm rod being coupled to the body by a first hinge, the pantograph lower arm rod being coupled to the body by a second hinge, the pantograph upper and lower arm rods extending parallelly to each other, at least two sensor carrying rods being disposed and coupled along said pantograph upper and lower arm rods, and wherein said at least one sensor is secured to a corresponding sensor carrying rod in a fixed manner such that a corresponding sensor axis is perpendicular to a sensor carrying rod axis, the sensor carrying rod being perpendicular to the tool body axis and the sensor axis staying parallel to the tool body axis for any opening of the deploying arms from the retracted configuration to the vertically extended configuration.

2. The production logging tool of claim 1, wherein each sensor carrying rod comprises a first end connected to the pantograph upper arm rod by a third hinge, and a second end connected to the pantograph lower arm rod by a fourth hinge such as to connect the pantograph upper arm rod to the pantograph lower arm rod in an articulated manner, distances between, on the one hand, the first hinge and the second hinge, and, on the second hand, the third hinge and the fourth hinge being around the same.

3. The production logging tool of claim 1, wherein at least one deploying arm comprises a pantograph upper arm rod and one pantograph lower arm rod such that said deploying arm holds one row of sensors.

4. The production logging tool of claim 3, wherein said row of sensors comprises a combination of phases identification sensors and local velocity measurements sensors.

5. The production logging tool of claim 1, wherein at least one deploying arm comprises a pantograph upper arm rod and two pantograph lower arm rods positioned parallelly to each other, side by side, such that said deploying arm holds two rows of sensors.

6. The production logging tool of claim 5, wherein said row of sensors comprises a combination of phases identification sensors and local velocity measurements sensors.

7. The production logging tool of claim 1, wherein each pantograph upper arm rod forms a single piece having a semi cylindrical hollow shape comprising a longitudinal oblong opening arranged in an upper part, a first pantograph upper arm rod being connected to a second pantograph upper arm rod through the outermost end hinge at an outermost end of the first pantograph upper arm rod and of the second pantograph upper arm rod.

8. The production logging tool of claim 1, wherein each pantograph upper arm rod comprises two separate, parallelly extending, side by side, pantograph upper arm rods, a first pantograph upper arm rod being connected to thea second pantograph upper arm rod through the outermost end hinge at an outermost end of the first pantograph upper arm rod and of the second pantograph upper arm rod.

9. The production logging tool of claim 8, wherein a first pantograph lower arm rod is connected to a first left pantograph upper arm rod through sensor carrying rods all along its length, and a second pantograph lower arm rod is connected to a first right pantograph upper arm rod through sensor carrying rods all along its length.

10. The production logging tool of claim 1, wherein each sensor is secured to the sensor carrying rod by means of a metal strip and a screw, the sensor carrying rod comprising an appropriate threaded hole cooperating with said metal strip and screw to securely maintain in place the body of the sensor against the sensor carrying rod.

11. The production logging tool of claim 1, wherein the first deploying arm is nested with the second deploying arm at said outermost ends intended for contacting the wall of the well, both deploying arms being connected by means of the outermost end hinge and a roller, said roller being free to rotate about an axis of said outermost end hinge and protruding over said outermost ends of the deploying arms such that the roller enters into a frictional engagement with the wall of the hydrocarbon well.

12. A downhole fluid analysis sensors vertical deploying method comprising the steps of:

providing a production logging tool according to claim 1 in a hydrocarbon well; and running the production logging tool along the hydrocarbon well while operating the deploying arms to vertically extend into engagement with a wall of the hydrocarbon well and to cause friction between outermost ends of the deploying arms and the wall of the hydrocarbon well, said articulated dual arms deploying arrangement being configured such that the sensor axis stays substantially parallel to the well axis for any vertical extension of the deploying arms when running the production logging tool along the hydrocarbon well.

* * * * *